United States Patent [19]

Wanderer

[11] 3,982,649

[45] Sept. 28, 1976

[54] BUNG FOR A BARREL

[75] Inventor: Herbert J. Wanderer, Wheatridge, Colo.

[73] Assignee: Denver Plastics, Inc., Denver, Colo.

[22] Filed: Jan. 30, 1975

[21] Appl. No.: 545,498

[52] U.S. Cl. ..... 217/108; 217/110; 220/307; 220/DIG. 19

[51] Int. Cl.[2] ..... B65D 39/04

[58] Field of Search ..... 217/110, 98, 108, 111, 217/107; 220/306, 307, 309, DIG. 19; 215/296, 302, 355, 358

[56] References Cited

UNITED STATES PATENTS

| | | | |
|---|---|---|---|
| 837,408 | 12/1906 | Johnstone | 215/355 |
| 2,066,481 | 1/1937 | Noll et al. | 215/302 |
| 2,081,132 | 5/1937 | Barnes | 217/110 |
| 2,196,785 | 4/1940 | Takiguchi | 215/355 |
| 2,266,270 | 12/1941 | Roth | 215/355 |
| 2,526,622 | 10/1950 | Martin | 215/355 |
| 2,746,632 | 5/1956 | Bramming | 215/358 |
| 2,921,708 | 1/1960 | Marcel | 215/296 |
| 3,133,666 | 5/1964 | Henchert | 220/307 |
| 3,381,841 | 5/1968 | Kusserow | 217/108 |
| 3,473,686 | 10/1969 | Kusserow | 217/108 |
| 3,742,898 | 7/1973 | Souza | 217/108 |

FOREIGN PATENTS OR APPLICATIONS

| | | | |
|---|---|---|---|
| 81,902 | 9/1956 | Denmark | 220/DIG. 19 |
| 1,120,713 | 7/1956 | France | 215/358 |
| 1,114,986 | 5/1968 | United Kingdom | 220/307 |

*Primary Examiner*—William T. Dixson, Jr.
*Assistant Examiner*—Allan N. Shoap
*Attorney, Agent, or Firm*—Ancel W. Lewis, Jr.

[57] ABSTRACT

A bung for the bung orifice of a pressurized beer barrel and the like including an outer shell having an external wall surface adapted for sealing engagement with the wall of the bung orifice and a closure head extending radially inwardly from an attachment at an intermediate point on the inside of the outer shell. The outer shell and closure head preferable are an integral molded plastic unit exhibiting yieldability and resiliency. The closure head is arranged so that opposed sections thereof are arranged along a continuous line from their attacment to the outer shell and meet at a common central area that forms a central swivel for the opposed sections whereby upon insertion into a bung orifice the closure head is arranged at an inwardly directed angle of inclination and the resiliency of the closure head together with the fluid pressure in the barrel applies a radially outwardly directed force via the closure head to the outer shell and external wall surface in a toggle joint-like action to increase the sealing effect of the bung in the bung orifice. The closure head may be formed on a slight angle of inclination to the outer shell or be provided with structure that causes it to assume this angle upon insertion into the bung orifice when the outer shell is placed under compressive forces. In other forms the closure head has a column concentrically arranged within and spaced from the outer shell that is attached at its inner end to the closure head to strengthen the closure head and form a means which the puller tool may grip to pull on the closure head to reverse the position of the closure head, radially contract the outer shell and pull the bung from a bung orifice in a barrel and the like.

23 Claims, 23 Drawing Figures

BUNG FOR A BARREL

FIELD

This invention relates generally to closures for containers and more particularly to a novel and improved bung for pressurized beer barrels and the like.

BACKGROUND

In the art of container closures, solid wooden bungs and to some extent molded plastic bungs have been used to close off the bung orifice in a pressurized beer barrel. Among the disadvantages of the wooden bung is the fact that it in general is subject to all of the vicissitudes of a product of nature, it is moisture sensitive and will swell or contract, it may have holes, it is subject to spalling, all of which may result in leakage of pressure. Moreover, wooden bungs do not readily release or blow out under extreme or dangerous tank pressures where a blow out would be desirable. Molded plastic bungs on the other hand have the advantage of overcoming the above deficiencies inherent in a product of nature and may be made using rapid, low cost molding techniques.

In providing molded plastic bungs, consideration must be given to providing sufficient strength to allow the bung to be driven into place in the barrel without breakage and at the same time afford a pressure seal that will not malfunction under internal pressure even if the barrel is dropped and yet is capable of affording a release in the event tank pressures become excessively or dangerously high. Moreover, the bung must be sufficiently strong to facilitate its ready removal in its entirety with a removal tool. Examples of prior plastic bungs are shown and described in U.S. Pat. Nos. 3,381,841 and 3,476,686 and D-216,678 which are assigned to the assignee of the present invention. In these earlier patents, there is provided hollow outer shell shaped to be inserted into the bung orifice with an external surface that forms a pressure seal with the bung orifice wall together with a generally transverse closure head that is arranged so that there is a flexure in the closure head in response to placing the closure head under compression and also in response to its fluid pressure in the barrel to urge the outer shell against the bung orifice to further increase the sealing effect of the bung in the barrel hole. It is noted however that the closure head of these prior patents is not arranged along a continuous line from the attachment to the inside of the outer shell to the center but that opposed sections of the closure head have different spaced swivel points that are separated by a dome-shaped central cap forming a bottom of the column.

Accordingly, it is a general object of the present invention to provide a novel and improved bung that is particularly suitable for pressurized beer barrels.

Another object of this invention is to provide an improved bung for a pressurized barrel chiefly characterized by durability, minimizing of materials and of a construction that is easily molded from plastic without significant distortion.

Yet a further object of this invention is to provide an improved bung for a pressurized barrel that is made entirely of a resilient and yieldable thermoplastic material and is constructed to yield radially inwardly toward its center upon insertion into a typical bung orifice and expand radially outwardly away from its center due to construction and inherent resiliency of the material and also to barrel pressure to increase the sealing effect of the bung in the barrel orifice to maintain a seal even to dynamic pressure as when the barrel is dropped or the like.

Another object of this invention is to provide an improved bung for a barrel that is readily installed by means of an impact tool, seals effectively against leakage of the barrel under normal pressures, is self regulating in that the bung will leak to relieve barrel pressures during pressures that are higher than normal barrel pressures and will blow out in the event of sudden intense pressure buildup or dangerous tank pressures and further a bung that may be normally easily removed by a removal tool.

Still a further object of the present invention is to provide a novel and improved bung generally characterized by a resilient, substantially hollow outer shell that seals against the wall of the bung hole and a resilient transverse closure head extending inwardly from the inside of the outer shell arranged on a true normal or an incline from the outer attached edge toward the center in a continuous line to flex inwardly in a toggle-like action in response to inherent resiliency of the material and in response to barrel pressure to increase the sealing effect.

Yet another object of this invention is to provide a novel and improved bung for a pressurized barrel in which concentric column structure is provided on the transverse closure head to reinforce the closure head and to provide a means to reverse the closure head by concentrically uniform forces to facilitate the axially directed pulling removal of the bung by a bung removal tool.

A further object is to provide a bung that is constructed so that double drives may be readily removed from the barrel.

Other objects, advantages and capabilities of the present invention will become more apparent as the description proceeds taken in conjunction with the accompanying drawings, in which like parts bear the reference numerals:

Figure 1:
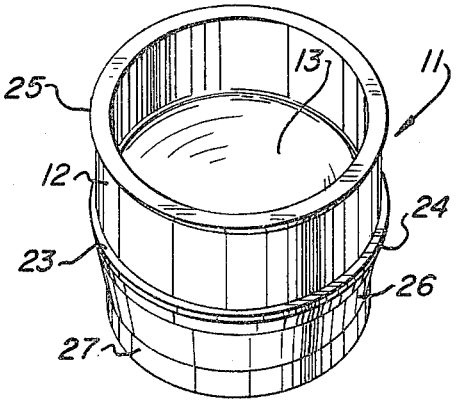
FIG. 1 is a perspective view of a bung embodying features of the present invention.
Figure 5:
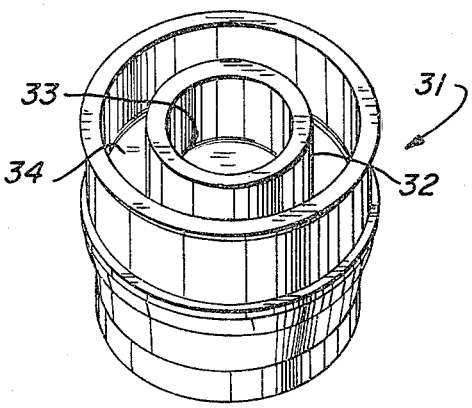
FIG. 5 is a perspective view of a modified form of bung with a concentric center column.
Figure 2:
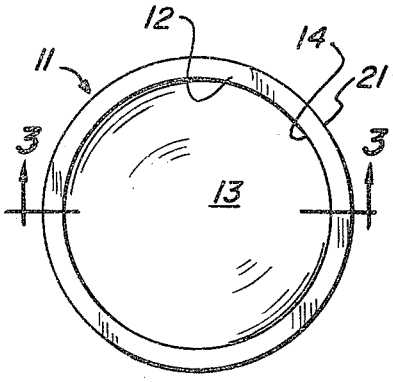
FIG. 2 is a top plan view of the bung shown in FIG. 1.
Figure 6:
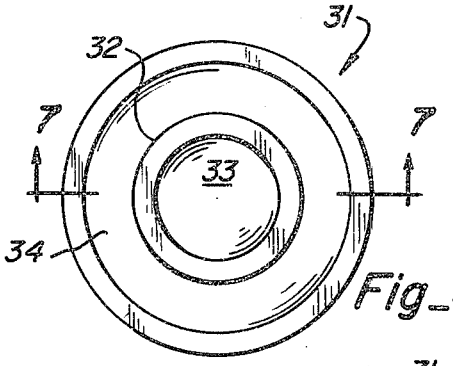
FIG. 6 is a top plan view of the bung shown in FIG. 5.
Figure 7:
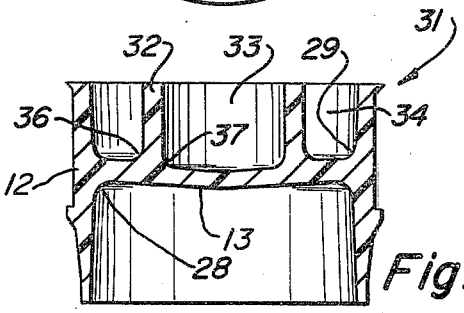
FIG. 7 is a vertical sectional view through the bung of FIGS. 5 and 6 and shown before being inserted in a bung orifice.
Figure 3:
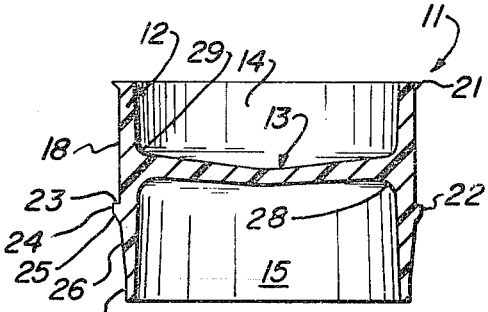
FIG. 3 is a vertical sectional view of the bung of FIGS. 1 through 2 before insertion into the bung orifice.
Figure 8:
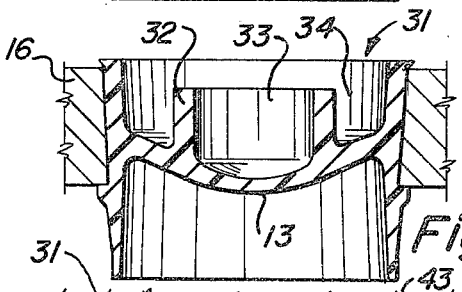
FIG. 8 is a vertical sectional view through the center of the bung of FIGS. 5 through 7 in an inserted operative position in a bung orifice.
Figure 4:
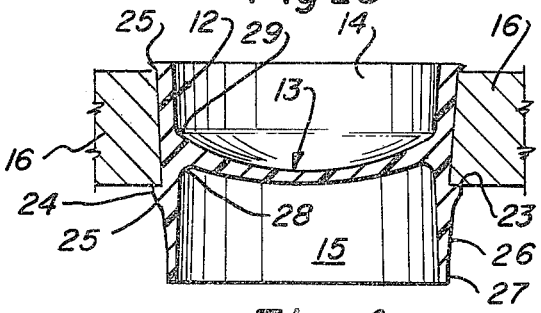
FIG. 4 is a vertical sectional view through the center of the bung of FIGS. 1 through 3 and shown in an inserted, operative position in a bung orifice.

Referring now to the drawings, in FIGS. 1 through 4 there is shown a bung 11 that is principally comprised of an outer shell 12 having a central inner cavity of passage and a closure head 13 within the outer shell 12 attached at an intermediate point between the inner and outer ends at the inside of the outer shell extending generally transverse thereto and separating the inner cavity into an outer cavity portion 14 and an inner cavity portion 15. The outer shell 12 is hollow except for the closure head 13 and therefore may be termed substantially hollow. The bung 11 is shown in FIG. 4 as positioned in a conventional bung orifice of a pressurized beer barrel designated by numeral 16 throughout the drawings having a slight inward taper as is conventional beer barrel construction.

The outer shell 12 of the bung shown has a circular transverse cross section and more specifically is generally cylindrical in shape to generally conform to the shape of the bung orifice so as to be insertable thereinto. The outer shell 12 has a main body section designated by numeral 18 which refers to that portion which conforms generally to the depth and diameter or the bung orifice. The main body section 18 as shown has a cylindrical external surface that as shown has substantially the same external diameter dimension throughout its lengthwise extent, subject of course to shrinkage which may result from the molding process. For some applications the external surface could be slightly tapered. The main body section 18 further substantially conforms in length to that of the depth or thickness of the bung wall 16 forming the bung orifice. The internal surface of the main body section tapers or diverges slightly radially outwardly from the attachment of the closure head to the inner and outer ends, respectively, of the outer shell 12.

Figure 10:
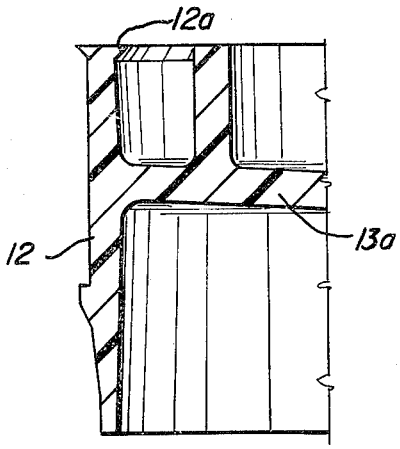
FIG. 10 is a vertical sectional view of a modified form of bung having a closure head of generally uniform thickness.
Figure 11:
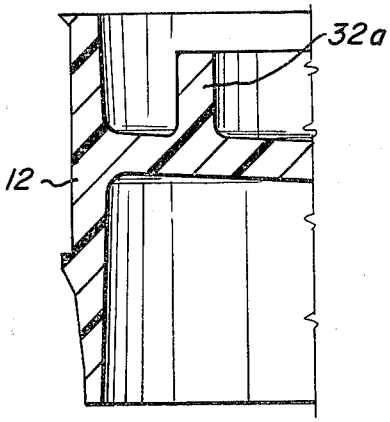
FIG. 11 is a vertical sectional view of a modified form of bung with a shortened center column terminating inwardly to the outer end of the outer shell.
Figure 12:
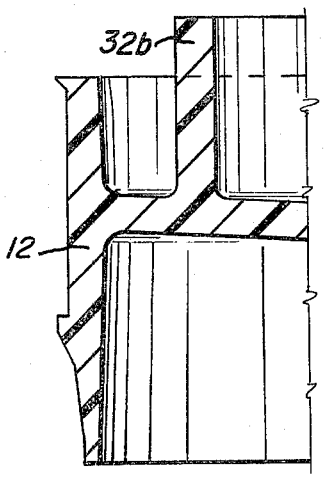
FIG. 12 is a vertical sectional view of a modified form of bung with an elongated center column extending beyond the outer end of the outer shell.

An outer raised or enlarged circumferentially continuous annular portion 21 is provided at the outer end of the outer shell which tapers or diverges outwardly from the main body section 18 on an angle to form a lip that serves to fully cover or overlay the periphery of the bung orifice so as to give the appearance of fully covering the bung orifice when viewed from the top. This affords a relatively wide rim on which indicia may be placed. For additional rim width a lip may extend radially inwardly from the inside of the outer shell wall as is shown at 12*a* in FIG. 10, but it is understood that for some applications neither of the inner or outer lips may be required.

Inwardly toward the barrel's interior of the main body section 18 of the outer shell, there is provided a raised or enlarged circumferentially continuous annular portion 22 that forms a detent or shoulder edge 23 for engaging the inside of the bung wall at the inner margin of the bung orifice to prevent the bung from prematurely creeping out of the bung orifice by pressure inside the barrel, but at the same time the flexibility of the material and size and shape thereof allows self regulating leakage and for some circumstances to blow out when the internal pressure exceeds dangerous or excessive maximum tank pressures.

Proceeding then toward the inner end, the inner raised portion 22 of the outer shell has a section 24 of a maximum diameter and uniform thickness along its length and a tapered section 25 that tapers in rather sharply, a section 26 that tapers in more gradually and terminates in an end section 27 of substantially uniform thickness which as shown has the thinnest wall thickness for the entire bung. However, it is understood that end section 27 need not be the thinnest for some applications. Sections 26 and 27 below portion 24 form a lead-in skirt that permits the bung to be readily inserted into the bung orifice prior to driving it into place with an impact tool. The outer shell 12 is specifically designed to afford maximum strength and minimum material and to this end it may be characterized as having a minimum thickness wall. It has been found that a major portion of the wall thickness of the outer shell need be only about 25% or less of the external diameter of the outer shell.

The closure head 13 as viewed in plan in FIG. 2 is generally circular in shape to resemble a disc and as viewed in a vertical section through the center thereof is generally concavo-convex in shape to resemble a diaphram. The outer marginal edge of the closure head 13 is attached throughout its circumference to the inside of the outer shell and more particularly is located between the inner and outer ends of the main body section 18 so that preferably the central part of the closure head is closer to the inner end of the outer shell than its outer marginal edge which is attached to the outer shell. While this location of the attachment of the closure head 13 is preferred for some applications it is understood that it may be located at other points along the shell and the present invention is not limited to this position. It is seen that in this arrangement the closure head extends inwardly at a slight angle of inclination toward the inner end of the outer shell from the attachment to the outer shell on the same angle throughout its circumference and that the closure head is arranged along a continuous line from the attachment to the outer shell to a central area of center thereof. This continuous line shown in FIGS. 1 through 4 in the substantially concavo-convex cross section shape is a curve line. By making the closure head of a resilient material such as a molded plastic it will be observed that when a radially inwardly directed compression force is applied to the outer shell which is also made of a resilient material such as a molded plastic as when it is inserted into the bung orifice the closure head bends or bows inwardly at the center to increase the angle of inclination of the closure head. The resiliency of the closure head together with the fluid pressure within the barrel act against the closure head to increase the sealing effect of the bung in the bung orifice.

This construction and action of the closure head 13 in the outer shell 12 may be likened to a toggle joint. A common definition of a toggle joint is a kneelike joint that transmits pressure at right angles wherein a pair of opposed arms are joined at an angle on a central swivel and exert a force at the outer ends of the arm at right angles to the movement of the inner swiveled ends thereof. In a like manner the closure head may be considered as having a pair of opposed sections that meet at an angle in the center or central area at a common swivel and as radially inwardly directed forces are applied thereto these opposed sections act like a pair of opposed toggle arms and move to decrease the angle of inclination in a toggle-like action as best seen in FIG. 4. The construction and action of the closure head in the outer shell may also be characterized as an "oil can" effect. The resiliency of the closure head and internal pressure in the tank cause these opposed sections to apply a substantially uniform radially outwardly directed force via the closure head to the inner circumference of the outer shell to increase the sealing effect of the bung in the bung orifice which sealing effect is greatest in the area opposite the attachment of the closure head to the inside of the outer shell. A principal advantage of a common, central swivel is that there is less tendency for the bung to cock in the bung orifice.

It is observed that while the concavo-convex shape of the closure head is shown having a curved continuous line from its attachment to the center thereof that an arrangement with a continuous straight line from the outer edge to the center is also suitable for providing the same toggle joint-like action. In this case the closure head would be essentially of a slight conical shape moving from a circle at the outer periphery attached to the outer shell to a common central area or center point. Forms of this type will be described more fully hereinafter with reference to FIGS. 18 through 23.

At the attachment of the closure head to the inside of the outer shell, there is an inside thickened radius portion 28 and an outside thickened radius portion 29 increasing the mass of the material at the attachment and providing added strength. The location of the attachment of the closure head to the inside of the outer shell then has significance in relation to where the sealing forces are applied to the outer shell. In this regard, as shown the location of the center point of this attachment is inwardly of a midpoint of the length of the main body section 18 and more particularly the center point of this attachment is between 2/10 and 8/10 of the total length from the outer end of the main body section 18 to the center point of attachment. Again main body section 18 is that part of the bung that is substantially coextensive in length with the bung orifice.

The closure head 13 shown in FIG. 3 has less thickness in the central area than at the outer marginal edge where it gradually increases in thickness from the center of the closure head toward the outer marginal edge where it fastens to the inside of the outer shell. This results in providing more mass to strengthen the outer shell where necessary and a reduction in thickness at the center area because the thickness of the closure head can vary in accordance with the load or force it is subjected to and therefore the closure head can be thinner at the center and thicker at the outer marginal edge.

The outer shell and closure head require a degree of flexibility or yieldability to contract or deform during insertion of the bung and resilience to expand and generally conform to the tapered bung orifice when put under compressive forces in the bung orifice. For this purpose the qualities of a plastic or more specifically a thermo-plastic resin such as elastomers are suited. Other elastomeric materials such as rubber or soft plastics are also suitable. The thickness range of the outer shell in relation to total diameter as above discussed will allow it to be compressed upon insertion into the bung orifice and expand so that particularly the sealing surface engages the bung orifice wall. A closure head made of this same material is yieldable to contract to increase the bow or angle of inclination upon insertion and once in place exerts an outwardly directed radial force against the bung orifice wall tending to increase the sealing effect. The outer shell and closure head are shows as made of a one piece integral unit from molded plastic. The present invention is not limited to a one piece unit but the closure head may be made separately and inserted into the outer shell and provide similar results.

Referring now to FIGS. 5 through 9, there is shown a modified form of bung 31 having the same outer shell and inner closure head construction as FIGS. 1 through 4 so that the above description and reference numerals applies to similar structure in the form shown in FIGS. 5 through 9. In this form there is provided a substantially hollow cylindrical column 32 concentrically arranged within the outer shell and spaced radially from the center leaving a hollow center cavity 33 and radially spaced from the outer hollow shell leaving an intermediate cavity 34. The column shown is centered relative to the outer shell wall so that the center of its wall is approximately one half the distance to the center of the outer shell wall for a balanced or uniform concentricity. The outer end of the column is shown as coextensive with that of the outer end of the outer shell but this may vary for different applications.

Figure 9:
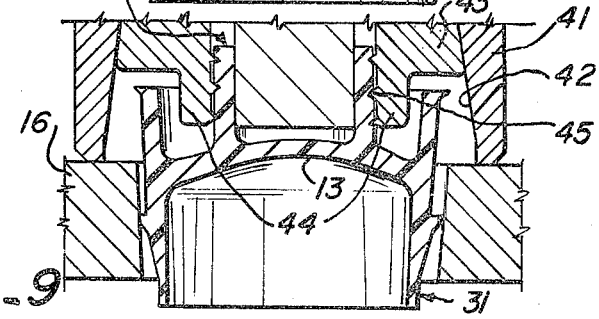
FIG. 9 is a vertical sectional view through the center of the bung of FIGS. 5 through 8 with a pulling device pulling the bung from the orifice.

An outer thickened radius portion 36 is provided at the attachment of the column to the closure head on the outside and an inner thickened radius portion 37 is provided at the attachment of the column to the closure head on the inside. The center column 32 serves to strengthen the closure head allowing the closure head to be made of less material or thinner in cross section and aids in its resistance to compression forces when the bung is inserted into the bung orifice, but the toggle or oil can action is still in relation to opposed sections and about a center swivel common to both sections. Moreover, the center column 31 affords additional strength in the outer or exposed portion of the bung that is engages by an impact tool during installation. Finally, the center column 32 affords a means by which the bung can be removed by the use of a removal tool which applies an axial force thereto and reverses the inwardly directed bow of the closure head to an outwardly directed bow, thereby contracting the inner wall of the outer shell as shown in FIG. 9 making it easier to pull the bung from the bung orifice. A feature of a circular column of uniform thickness is that a plurality of equally spaced circumferentially arranged points may be gripped by a puller tool to pull evenly and uniformly on the closure head.

Briefly, the removal tool shown in FIG. 9 has an outer housing 41 with a rearwardly converging inner cam surface 42 and an inner collet 43 movable coaxially inside the outer housing having circumferentially arranged and spaced apart fingerlike segments 44 at equally spaced intervals about the axis with each segment having one or more teeth 45 that move radially inwardly and grip the outside of the column as the collect is moved axially by a motive power source such as an air cylinder (not shown) coupled to the collet. The exterior surface of the collet moves against the inner cam surface 42. It is understood that other removal tools such as a power-driven auger may engage portions of the bung and be moved axially to accomplish the same removal action above described.

While the center column and pulling device shown afford one means of removing the bung from a bung orifice, it is understood that a bung made in accordance with the present invention can be removed in other ways, as by gripping the outside of the outer shell or the inside of the outer shell. Moreover, holes could be provided in the outer shell and tongs or the like could be used to grip and pull the bung.

Referring now to FIGS. 13 through 17, there is shown in top plan views some modifications in the column structure on the closure head of the outer shell which also functions to reinforce the closure head, the outer portion of the bung impacted by an installing tool and affording a means of gripping the bung to pull it from the bung orifice.

Figure 13:
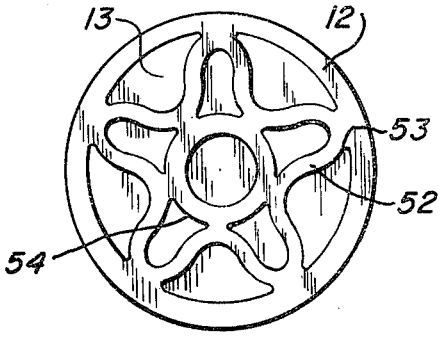
FIG. 13 is a top plan view of a modified form of bung with intermediate structure between the column and outer shell.

In the form shown in FIG. 13 there is provided between the hollow central column 32 and outer shell a generally sinuous web 52 integrally united with the inside of the outer shell at 53 and the inner column 54 having a reference along a concentric circle midway between the outer shell and the center column.

Figure 14:
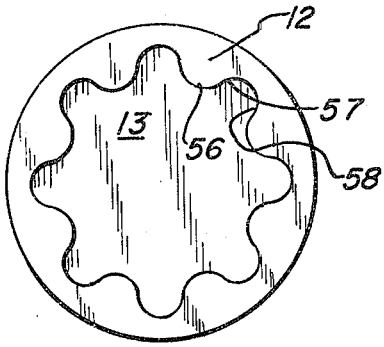
FIG. 14 is a top plan view of a modified form of bung with radially inwardly projecting ribs on the inside of the outer shell and with the central area open.

In FIG. 14, the outer shell is provided with a plurality of equally spaced, circumferentially arranged inwardly extending ribs 56 integrally united with the inside of the outer shell. At the attachment of these ribs to the outer shell there is a pair of thickened radius sections 57 and 58 forming arcuate semicircular slots between ribs 56 affording a means whereby the bung may be gripped at equally spaced circumferentially arranged intervals radially inside the outer shell. Again the central area of this form is left open.

Figure 15:
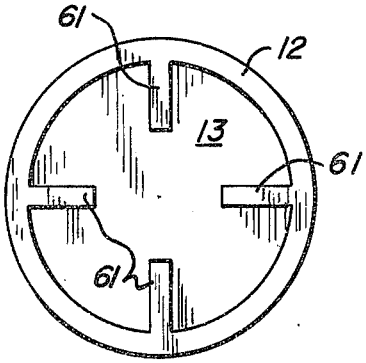
FIG. 15 is a top plan view of a modified form of bung with only four radially inwardly projecting ribs affixed at their outer ends of the outer shell and the central area open.
Figure 16:
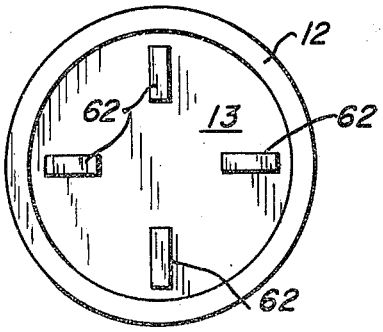
FIG. 16 is a top plan view of a modified form of bung with four radially inwardly projecting ribs detached and spaced from the outer shell at their outer ends with a central area open.
Figure 17:
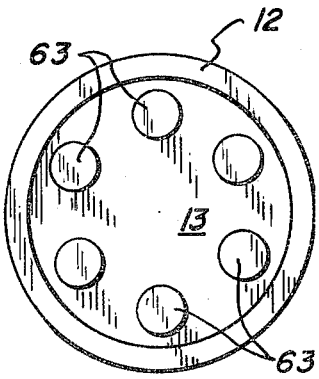
FIG. 17 is a top plan view of yet another modified form of bung with cylindrical ribs spaced from the outer shell and the central area leaving the central area open.

In the form shown in FIG. 15 there is provided four rectangular shaped equally spaced circumferentially arranged radially extending ribs 61 between the outer shell and center with a central area left open. These ribs are affixed at their outer edge to the inside of the outer shell. In the form of FIG. 16, four rectangular shaped ribs 62 are provided that are spaced from the inside of the outer shell affording greater radial flexibility for the outer shell if desired. In yet another form shown in FIG. 17 there are provided six equally spaced circumferentially arranged ribs 63 on the closure head that have centers on a concentric circle between the center and outer shell of the outer housing affording additional outer strength in the bung and reinforcing the closure head while at the same time may be gripped to pull the bung out of the orifice.

Figure 18:
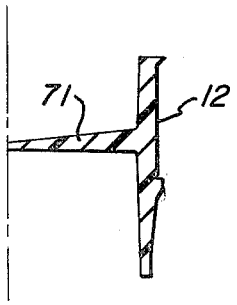
FIG. 18 is a vertical sectional view of a bung with a transverse closure head arranged normal to the outer shell.
Figure 19:
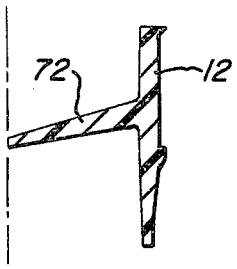
FIG. 19 is a vertical sectional view of a bung with a transverse closure head arranged along a straight line at an angle of inclination from the shell to the center thereof.

As above mentioned the transverse closure head in the outer shell may be formed or arranged so that it is perpendicular or normal to the longitudinal axis of the outer shell but will assume the desired inwardly directed angle of inclination in the bung orifice to provide the same toggle joint-like action as the bung does which is illustrated in FIG. 4. Referring now to FIG. 18 the bung shown has a closure head 71 that is formed with the inside surface normal to the longitudinal axis and gradually increasing in thickness from the center to the outer marginal edge so that this shape bows inward when inserted into the bung orifice. Closure head 72 of FIG. 19 is shown as having a similar shape as head 71 but formed on an angle of inclination which is illustrative of a closure head on a continuous straight line.

Figure 20:
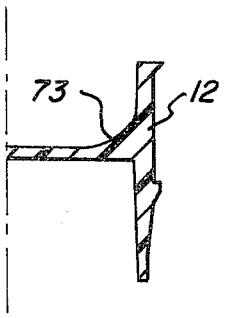
FIG. 20 is a vertical sectional view of a bung with a transverse closure head arranged normal to the outer shell with a thickened radius section.
Figure 23:
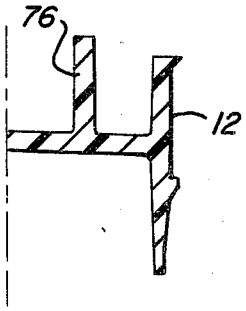
FIG. 23 is a vertical sectional view of a bung with a closure head normal to the outer shell and an outer annular member projecting above the outer shell.

Referring now to FIG. 20 the closure head shown is again arranged normal to the outer shell but is provided with a thickened radius section 73 that causes the closure head to bow inwardly under compression forces.

Figure 21:
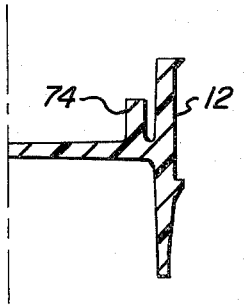
FIG. 21 is a vertical sectional view of a bung with an outer annular member on the transverse closure head in close proximity to the inside of the outer shell.
Figure 22:
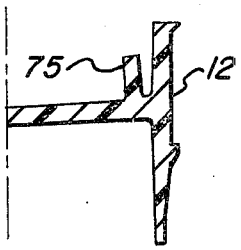
FIG. 22 is a vertical sectional view of a bung with an outer annular member arranged on an incline.

The form shown in FIG. 21 has an upstanding member 74 integral with the closure head in close proximity to the inside of the outer shell which moves against the outer shell upon insertion to cause the closure head to bow inwardly rather than outwardly. The upstanding member 75 in FIG. 22 is tilted radially inwardly on an incline and accomplishes the same effect. The upstanding members 74 or 75 may be annular or circumferentially continuous or discontinuous. Finally the upstanding member 76 shown in FIG. 23 on a transverse closure head projects above the outer shell and is engaged by the hammer so that the closure head will assume the inwardly bowed position in the bung orifice upon impact from a hammer face.

The above described bungs are particularly suited for removal from the barrel in the event of a double drive. An ice hook type tool may be used to grip the inside of the outer shell and affords the ready removal of a bung from the inside of the barrel.

Although the present invention has been described with a certain degree of particularity, it is understood that the present disclosure has been made by way of example and that changes in details of structure may be made without departing from the spirit thereof.

What is claimed is:

1. A bung for a container having a wall with a bung orifice comprising:

a resiliently yieldable outer shell with an inner cavity, an inner end and an outer end, said outer shell having a main body section substantially conforming in length to the thickness of the container wall defining said bung orifice and having an external wall surface adapted for sealing engagement with the wall of the container defining said bung orifice, said external wall surface of said main body section being greater in size than the internal dimension of the bung orifice for the radially inwardly directed compression of said main body section upon the forcible insertion of said outer shell into a bung orifice; and a resiliently yieldable closure head within the outer shell having an outer annular marginal edge attached at the inside of the outer shell, the center point of said attachment along said outer shell being spaced from and between the inner and outer ends of said main body section, said closure head extending generally transverse to said outer shell and arranged along a continuous line from the attachment to the outer shell and meeting at the center of said closure head, said closure head being yieldable to an inwardly bowed position under compression in response to the radially inwardly directed compression on said main body section with the resiliency of said closure head under compression applying radially outwardly directed forces via the closure head that are substantially uniformly applied to the circumference of the outer shell tending to increase the sealing effect of the bung in the bung orifice.

2. A bung as set forth in claim 1 wherein said closure head is generally concavo-convex in shape and is arranged along a curved continuous line from the attachment to the outer shell to the common central area.

3. A bung as set forth in claim 1 wherein said closure head is arranged substantially normal to the outer shell along a straight line from the attachment to the outer shell to the common central area.

4. A bung as set forth in claim 3 wherein said closure head has an outer portion that causes it to assume an inwardly directed angle of inclination upon insertion into the bung orifice.

5. A bung as set forth in claim 3 wherein said closure head has an outer upstanding portion projecting above the outer shell adapted to be engaged by a driving tool for pre-placing the closure head upon the insertion into the bung orifice.

6. A bung as set forth in claim 1 wherein said outer shell and said closure head are made as an integral molded plastic unit having yieldable and resilient characteristics.

7. A bung as set forth in claim 1 wherein said outer shell has an external raised portion forming a lip at the outer end to cover the periphery of the bung orifice.

8. A bung as set forth in claim 1 wherein said outer shell has an external raised portion forming a shoulder adjacent its inner end to hold the bung in place in the bung orifice.

9. A bung as set forth in claim 1 wherein said external wall sealing surface of the outer shell is cylindrical and has a substantially uniform external diameter throughout its lengthwise extent.

10. A bung as set forth in claim 1 wherein said closure head supports concentric column means that extend generally parallel to the outer shell and away from the outer surface of the closure head.

11. A bung as set forth in claim 10 wherein said column means is in the form of a hollow cylindrical body integrally united with said closure head and spaced inwardly of and concentrically arranged within the outer shell to form a pair of concentric cavities outwardly of the closure head.

12. A bung as set forth in claim 10 wherein said column means is coextensive with the outer end of said outer shell.

13. A bung as set forth in claim 10 wherein said column means terminates below the outer end of said outer shell.

14. A bung as set forth in claim 10 wherein said column means extends beyond the outer end of said outer shell.

15. A bung as set forth in claim 10 inclusive of a reinforcing web integrally united with the inside of said outer shell and the outside of said column means at circumferentially spaced equal intervals around the column means and outer shell in a sinuous pattern having a reference along a concentric circle midway between the outer shell and said column means.

16. A bung as set forth in claim 10 wherein said column means is in the form of equally spaced circumferentially arranged inwardly radially extending ribs integrally united with the inside of the outer shell and terminating at their inner ends to leave the central area of the closure head open.

17. A bung as set forth in claim 10 wherein said column means is in the form of a plurality of equally spaced radially extending ribs spaced at their outer ends from the inside of the outer shell and terminating at their inner ends to leave the central area of the closure head open.

18. A bung as set forth in claim 17 wherein said ribs have a rectangular transverse cross sectional shape.

19. A bung as set forth in claim 17 wherein said ribs have a circular transverse cross sectional shape.

20. A bung as set forth in claim 1 wherein said closure head has a substantially uniform thickness from the inside of the outer shell to its center.

21. A bung as set forth in claim 1 wherein said outer shell has a main body section coextensive with the depth of the bung orifice, the attachment of said closure head being inwardly of a point midway along said main body section.

22. A bung for a pressurized beer barrel and the like, said beer barrel having a wall with a bung orifice defined by a surface that extends in a direction inwardly into the barrel along said wall from an external surface of said wall comprising:

a resiliently yieldable outer shell with a central cavity and an inner end adapted to be positioned toward the inside of the barrel and an outer end adapted to be positioned outside the barrel, said outer shell having a main body section with an external wall sealing surface adapted for sealing engagement with said barrel wall defining said bung orifice and substantially conforming in length to the thickness of said barrel wall defining said bung orifice, an outer external raised portion forming a lip at the outer end to cover the periphery of the bung orifice, an inner external raised portion forming a shoulder adjacent its inner end to hold the bung in place in the bung orifice and a lead-in skirt portion of a minimum thickness and external diameter, said external sealing surface being substantially cylindrical and having a generally uniform external diameter throughout its lengthwise extent, said external wall surfaces of said main body section being greater in size than the internal dimension of the bung orifice for the radially inwardly directed compression of said body section upon the forcible insertion of said outer shell into a bung orifice;

a generally concavo-convex closure head within said outer shell having an outer marginal edge integrally attached at the inside of the outer shell at a center point inwardly of the midpoint of said main body section, said closure head and outer shell being molded as a one piece resiliently yieldable plastic material, said closure head extending generally transverse to said outer shell and arranged along a continuous curved line from the attachment to the outer shell and meeting at the center of said closure head, said closure head being yieldable to an inwardly bowed position under compression in response to the radially inwardly directed compression on said main body section with the resiliency of said closure head under compression applying radially outwardly directed forces via the closure head that are substantially uniformly applied to the circumference of the outer shell tending to increase the sealing effect of the bung in the bung orifice and in addition the fluid pressure within the barrel against the closure head increasing said sealing effect, said closure head being of less thickness at the central area than at the outer marginal edge.

23. In a pressurized beer barrel, the combination comprising:

a barrel wall with a bung orifice defined by a surface that extends in a direction inwardly into the barrel along said wall from an external surface of said wall;

a bung of resiliently yieldable plastic material for sealing said bung orifice, said bung having an outer shell with a central cavity and an inner end adapted to be toward the inside of the barrel and an outer end adapted to be toward the outside of the barrel, said outer shell having a main body section with an external wall sealing surface adapted for sealing engagement with the barrel wall defining the bung orifice, said external wall surface of said main body section being greater in size than the internal dimension of the bung orifice for the radially inwardly directed compression of said main body section upon the forcible insertion of said outer shell into a bung orifice; and a generally concavo-convex shaped closure head within the outer shell extending generally transverse thereto, said closure head having an outer marginal edge integrally united at the inside of the shell between the inner and outer ends thereof, said closure head extending generally transverse to said outer shell and arranged along a continuous line from the attachment to the outer shell and meeting at the center of said closure head, said closure head being yieldable to an inwardly bowed position under compression in response to the radially inwardly directed compression on said main body section with the resiliency of said closure head under compression applying radially outwardly directed forces to the shell to increase the sealing effect of the bung in the bung orifice, said closure head having a column supported thereon extending parallel to the wall of the shell away from the outer surface of the closure head and radially inwardly therefrom at at least equal circumferentially spaced points about the center to reinforce the closure head and provide a uniformity of pull on the closure head radially inwardly of the outer shell to reverse the bowed relationships of said outer and inner surfaces of said closure head in response to an axially movable puller tool applied to said column portion whereby the side wall of the outer shell contracts radially inwardly when the position of the closure head is reversed to be outwardly bowed.

* * * * *